US006766965B2

(12) United States Patent
D'Arrigo

(10) Patent No.: US 6,766,965 B2
(45) Date of Patent: Jul. 27, 2004

(54) TWIN TUBE HYDRAULIC COMPENSATOR FOR A FUEL INJECTOR

(75) Inventor: Angelo D'Arrigo, Pisa (IT)

(73) Assignee: Siemens Automotive Corporation, Auburn Hills, MI (US)

( * ) Notice: Subject to any disclaimer, the term of this patent is extended or adjusted under 35 U.S.C. 154(b) by 293 days.

(21) Appl. No.: 09/942,629

(22) Filed: Aug. 31, 2001

(65) Prior Publication Data

US 2003/0042325 A1 Mar. 6, 2003

(51) Int. Cl.[7] ..... B05B 1/08

(52) U.S. Cl. ..... 239/102.2; 239/88; 239/533.4; 239/533.9; 251/57; 251/129.06

(58) Field of Search ..... 239/88, 91, 96, 239/102.2, 533.3, 533.4, 533.9; 251/57, 129.06; 123/446, 498; 310/326, 346, 327

(56) References Cited

U.S. PATENT DOCUMENTS

| | | | | |
|---|---|---|---|---|
| 4,022,166 A | | 5/1977 | Bart | |
| 4,550,744 A | | 11/1985 | Igashira et al. | |
| 4,584,980 A | | 4/1986 | Weiger et al. | |
| 4,725,002 A | | 2/1988 | Trachte | |
| 4,750,706 A | | 6/1988 | Schlagmuller | |
| 4,813,601 A | * | 3/1989 | Schwerdt et al. | 239/91 |
| 5,186,151 A | | 2/1993 | Schwerdt et al. | |
| 5,740,969 A | | 4/1998 | Hoffmann et al. | |
| 5,810,255 A | | 9/1998 | Itoh et al. | |
| 5,819,710 A | | 10/1998 | Huber | |
| 5,875,764 A | * | 3/1999 | Kappel et al. | 123/446 |
| 6,079,636 A | | 6/2000 | Rembold et al. | |
| 6,142,443 A | * | 11/2000 | Potschin et al. | 239/102.2 |
| 6,148,842 A | | 11/2000 | Kappel et al. | |
| 6,302,333 B1 | * | 10/2001 | Hoffmann et al. | 239/102.2 |
| 6,313,568 B1 | * | 11/2001 | Sullivan et al. | 310/346 |

FOREIGN PATENT DOCUMENTS

| | | |
|---|---|---|
| DE | 43 06 072 C2 | 2/1993 |
| DE | 43 06 073 C1 | 2/1993 |
| DE | 44 06 522 C1 | 2/1994 |
| DE | 44 12 948 A1 | 4/1994 |
| DE | 195 04 175 A1 | 2/1995 |
| DE | 195 29 667 A1 | 8/1995 |
| DE | 197 27 992 A1 | 7/1997 |
| DE | 197 50 149 A1 | 11/1997 |
| DE | 198 04 196 A1 | 2/1998 |
| DE | 198 34 461 A1 | 7/1998 |
| DE | 198 34 673 A1 | 7/1998 |
| DE | 198 36 561 A1 | 8/1998 |
| DE | 198 38 862 A1 | 8/1998 |
| DE | 198 57 338 C1 | 12/1998 |
| DE | 199 52 946 A1 | 11/1999 |
| EP | 0 795 081 B1 | 11/1995 |
| WO | WO 98/44256 | 10/1998 |

* cited by examiner

*Primary Examiner*—Steven J. Ganey

(57) ABSTRACT

A fuel injector preferably has a body, a closure member, a piezoelectric device, and a hydraulic thermal compensator. The body extends along an axis. The closure member is displaceable with respect to the body between a first configuration and a second configuration. The first configuration prevents fuel flow through the body, and the second configuration permits fuel flow through the body. The piezoelectric device displaces the closure member from the first configuration to the second configuration. The compensator is coupled with the piezoelectric device and includes a first tube, a second tube, a piston, and fluid. The first tube extends along the axis from a first end portion that occludes the first tube. The first end portion contiguously engages a first one of the body, the closure member, and the piezoelectric device. The second tube is telescopically received in the first tube. The second tube extends along the axis from a second end portion that generally occludes the second tube and that defines an orifice. The second tube is fixed with respect to a second one of the body, the closure member, and the piezoelectric device. The piston is telescopically received in the second tube. And the fluid is displaceable through the orifice to move the first tube relative to the second tube.

20 Claims, 4 Drawing Sheets

TWIN TUBE HYDRAULIC COMPENSATOR FOR A FUEL INJECTOR

FIELD OF THE INVENTION

This disclosure generally relates to piezoelectric actuators, and more particularly to a compact hydraulic compensator for a piezoelectric actuator of a fuel injector for an internal combustion engine.

BACKGROUND OF THE INVENTION

A conventional piezoelectric actuator can include a ceramic structure that changes a dimension when an electric potential is applied across the structure. Typically, the dimension can change, for example, approximately 0.12%. The dimension change for an actuator having a plurality of individual structures stacked along an axis is multiplied as a function of the number of structures in the piezoelectric actuator stack. A voltage application can result in a nearly instantaneous expansion of the actuator and corresponding movement of any structure connected to the actuator. In the field of automotive technology, especially, in internal combustion engines, it is believed that there is a need for the precise opening and closing of an injector valve element for optimizing the spray and combustion of fuel. Therefore, in internal combustion engines, piezoelectric actuators are now employed for the precise opening and closing of the injector valve element.

During operation, the components of an internal combustion engine can experience significant thermal fluctuations that result in the thermal expansion or contraction of the engine components. It is believed that, in a fuel injector assembly, the valve body may expand during operation due to the heat generated by the engine and a valve element may contract due to contact with the relatively cold fuel. If a piezoelectric actuator stack is used for the opening and closing of an injector valve element, the thermal fluctuations can result in valve element movements that can be characterized as an insufficient opening stroke, or an insufficient sealing stroke. This is because of the low thermal expansion characteristics of the piezoelectric actuator as compared to the thermal expansion characteristics of other engine components. For example, if a piezoelectric actuator stack is capable of 30 microns of movement and a valve element contracts 10 microns due to temperature fluctuations, the piezoelectric actuator stack has lost 33% of its overall movement. Therefore, any expansions or contractions of a valve element can have a significant effect on the fuel injector operation.

It is believed that a variety of component materials have been evaluated in order to identify a combination that has substantially similar thermal expansion properties throughout the range of operating conditions to which a fuel injector is exposed. Generally, the component materials that have been evaluated either do not exhibit sufficiently similar thermal expansion properties or involve exotic materials that are expensive or difficult to manufacture.

It is believed that there are a number of disadvantages in attempting to match the thermal expansion properties of different components. These disadvantages are believed to include merely approximating a change in length of the piezoelectric actuator stack, or accurately approximating the change in length of the piezoelectric actuator stack for a narrow range of temperature changes.

A hydraulic bearing can also provide compensation for a fuel injector. Referring to FIG. 4, an example of a conventional hydraulic bearing 100 includes a single cylindrical body 102 and a pair of chambers 104*a*, 104*b* located along a longitudinal axis 106 of the bearing 100. The chambers 104*a*, 104*b* are separate by a portion of the body 102 that includes a modified screw orifice 108. A first piston 110 that contiguously engages an end of a piezoelectric device 112 also defines a portion of the chamber 104*a*. A second piston 114 also defines a portion of the chamber 104*b*. The second piston 114 includes a plug 114*a* that is used in a hydraulic oil filing/purging operation. In the illustrated example, the plug 114*a* also centers a compression spring 116. An adjusting screw (not shown) installed in a cap portion of a fuel injector housing (not shown) varies the compression force provided by the spring 116. A flange 102*a* fixes the body 102 with respect to the fuel injector housing. The hydraulic bearing 100 controls or damps movement of the piezoelectric device 112 by virtue of the force required to displace fluid through the orifice 108. The size of the orifice 108 determines the damping effect of the hydraulic bearing 100. As the hydraulic bearing 100 experiences expansion or compression, e.g., due to thermal changes, the pistons 110, 114 move, thereby displacing the fluid through the orifice 108. However, the fluid being forced through the orifice 108 resists rapid movement of the pistons 110,114. By reducing the size of the orifice 108, stiffer compensation is provided by the hydraulic bearing 100.

Conventional hydraulic bearings are believed to suffer from a number of disadvantages. These disadvantages are believed to include an elongated longitudinal dimension that adds to the overall length of a fuel injector, and a great number of precision components that are expensive to manufacture and assemble.

Thus, it is believed that there is a need for a compact, low cost, and accurate device to compensate for the changes in operation as a fuel injector experiences dimensional changes, e.g., due to temperature fluctuations.

SUMMARY OF THE INVENTION

The present invention provides a compensator for longitudinally positioning along an axis a device relative to a body. The compensator comprises a first tube, a second tube, a piston, and fluid. The first tube extends along the axis from a first end portion that occludes the first tube. The second tube is telescopically received in the first tube. The second tube extends along the axis from a second end portion that generally occludes the second tube and that defines an orifice. The piston is telescopically received in the second tube. And the fluid is displaceable through the orifice to move the first tube relative to the second tube.

The present invention also provides a fuel injector. The fuel injector comprises a body, a closure member, a piezoelectric device, and a compensator. The body extends along an axis. The closure member is displaceable with respect to the body between a first configuration and a second configuration. The first configuration prevents fuel flow through the body, and the second configuration permits fuel flow through the body. The piezoelectric device displaces the closure member from the first configuration to the second configuration. The compensator is coupled with the piezoelectric device and includes a first tube, a second tube, a piston, and fluid. The first tube extends along the axis from a first end portion that occludes the first tube. The first end portion contiguously engages a first one of the body, the closure member, and the piezoelectric device. The second tube is telescopically received in the first tube. The second tube extends along the axis from a second end portion that generally occludes the second tube and that defines an orifice. The second tube is fixed with respect to a second one of the body, the closure member, and the piezoelectric device. The piston is telescopically received in the second tube. And the fluid is displaceable through the orifice to move the first tube relative to the second tube.

The present invention also provides a method of assembling a compensator for a fuel injector. The method comprises providing a first tube extending along an axis from a first end portion occluding the first tube, filing the first tube with a volume of a fluid, inserting a second tube telescopically in the first tube, and inserting a piston telescopically in the second tube, inserting a plug in the piston. The second tube extends along the axis from a second end portion that generally occludes the second tube and that defines an orifice. The orifice is submerged in the volume of the fluid. The piston includes an aperture, and the plug is inserted in the aperture.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENTS

Figure 1:
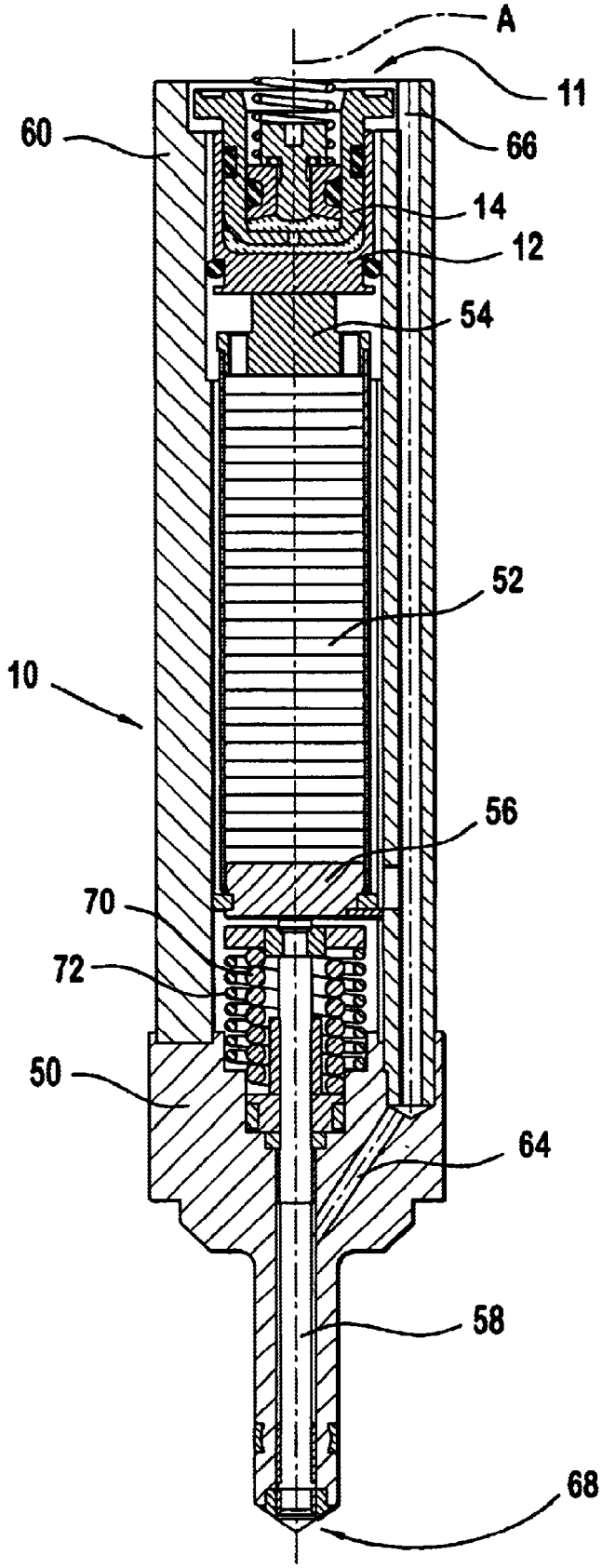
FIG. 1 is cross-section view of a fuel injector including a hydraulic compensator according to a preferred embodiment.

Referring to FIG. 1, a hydraulically compensated fuel injector 10 extends along a longitudinal axis A and comprises a housing 60 and a body 50. A piezoelectric device 52 extends along the longitudinal axis A between opposite axial end caps 54,56. A closure member 58 contacts the lower axial end cap 56 of the piezoelectric actuator stack 52, and a hydraulic compensator 11 is operatively coupled, e.g., contiguously engages, the upper axial end cap 54 of the piezoelectric device 52.

When the closure member 58 is in an open configuration, fuel can flow through a first passageway 66, through a second passageway 64, and out a fuel outlet 68. When a voltage is applied to the piezoelectric device 52, the piezoelectric device 52 expands. The expansion of piezoelectric device 52 causes the lower axial end cap 56 to push the closure member 58 to the open configuration, i.e., fuel is permitted to flow through the fuel injector 10. When the voltage to the piezoelectric device 52 is discontinued, the piezoelectric device 52 contracts, thus allowing the needle 58 to be moved, under the bias of at least one spring (an inner spring 70 and an outer spring 72 are illustrated), to a closed configuration, i.e., fuel is prevented from flowing through the fuel injector 10. The springs 70,72 also ensure that the closure member 58 remains in constant contact with the lower axial end cap 56 of the piezoelectric device 52.

Figure 2:
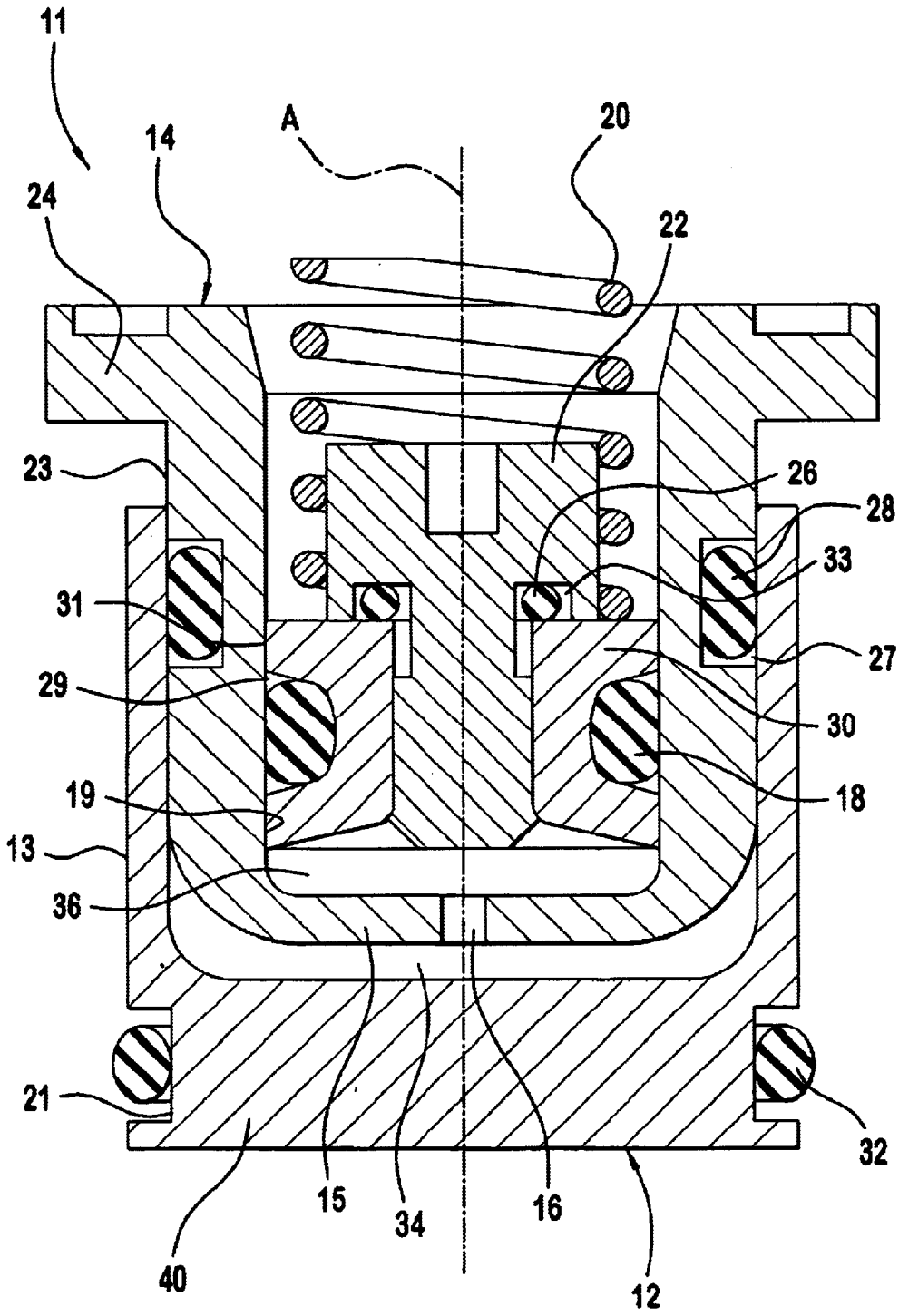
FIG. 2 is an enlarged cross-section view of the hydraulic compensator shown in FIG. 1.

Referring additionally to FIG. 2, the hydraulic compensator 11 preferably has a first tube 12 and a second tube 14. The first tube 12 moves telescopically with respect to the second tube 14 to adjust the longitudinal position of the piezoelectric device 52 along the axis A, e.g., in response to temperature variations. The first tube 12 is operatively coupled to, e.g., contiguously engages, the upper axial end cap 54 of the piezoelectric device 52. The second tube 14 is fixed, e.g., via a flange 24, with respect to the housing 60.

The first tube 12 preferably has an end portion 40 that occludes the first tube 12 and can contiguously engage the upper axial end cap 54. An O-ring 32 can be disposed in a groove 21 on an outer surface 13 of the first tube 12. The O-ring 32 centers the first tube 12 with respect to the housing 60.

The second tube 14 preferably has an end portion 15 that generally occludes the second tube 14 and defines an orifice 16. A preferred method for fabricating the second tube 14 is forming the second tube 14 by a deep drawn process. The method of deep drawing the second tube 14 insures a smooth finish on an inner surface 19 of the second tube 14. It should be recognized by those skilled in the art that the second tube 14 could alternatively be formed from a welded tube, roll formed from a thin sheet, or fabricated from any other suitable forming process. A preferred material for fabricating the second tube 14 is SAE 316L corrosion resistant steel. However, it should be recognized by those skilled in the art that different corrosion resistant materials might be used to fabricate the second tube 14. The second tube 14 is generally cylindrically shaped. The preferred method of construction and preferred material of construction for the first tube 12 can be the same or different as those of the second tube 14. Although it is likely to increase the axial length of the hydraulic compensator 11, the orifice 16 can comprise an orifice screw that is similar to the modified screw orifice 108 described above with regard to the conventional hydraulic bearing 100.

A sealing member 28 can be disposed in a groove 27 on an outer surface 23 of the second tube 14. The sealing member 28 seals the first tube 12 with respect to the second tube 14. The sealing member 28 according to a preferred embodiment is an O-ring, but those skilled in the art will recognize that other types of sealing components may be used.

The hydraulic compensator 11 preferably has a back-up piston 30 that reciprocates axially within the second tube 14.

A plug 22 is disposed in the back-up piston 30. An O-ring 18 can be disposed in a groove 29 on an outer surface 31 of the back-up piston 30. The O-ring 18, or any other type of sealing component, seals the back-up piston 30 with respect to an inner surface 19 of the second tube 14.

The hydraulic compensator 11 preferably has a first fluid chamber 34 that is defined between the first tube 12 and the second tube 14, and a second fluid chamber 36 that is defined between the back-up piston 30 and the second tube 14. The orifice 16 provides fluid communication between the first fluid chamber 34 and the second fluid chamber 36.

A substantially incompressible fluid is disposed in the first and second fluid chambers 34,36. A preferred fluid is hydraulic fluid, e.g., silicon oil. However, it should be recognized by those skilled in the art that other types of substantially incompressible hydraulic fluid might be substituted. The plug 22 is used to add and purge the hydraulic oil with respect to the first and second fluid chambers 34,36.

A resilient element 20 applies a bias force tending to displace the back-up piston 30 toward the orifice 16. The resilient element 20 can be a compression spring, e.g., a coil spring. The plug 22 can also serve to center the resilient element 20 in the hydraulic compensator 11. An O-ring 26 can be disposed in a groove 33 seal the plug 22 with respect to the back-up piston 30.

Accordingly, the hydraulic compensator 11 provides a method of compensating for relative expansion or contraction, e.g., as a result of temperature changes, of the components of the fuel injector 10. In particular, the relative telescopic movement of the first and second tubes 12,14 can adjust the longitudinal positioning along the axis A of the piezoelectric device 52, i.e., with respect to the injector housing 60 and the valve body 50.

During engine operation, as the temperature in the engine rises, the injector housing 60 and valve body 50 experience thermal expansion. At the same time, fuel flowing through the fuel injector 10 cools internal components such as the piezoelectric device 52 and the closure member 58, i.e., the internal components experience a different thermal expansion as compared with the injector housing 60 and the valve body 50.

The increase in temperature causes the injector housing 60 and valve body 50 to expand, which in turn causes compression of the resilient element 20. The compression force of the resilient element 20 is transferred to the hydraulic oil via the back-up piston 30. Thus, hydraulic oil is pushed out of the second fluid chamber 36 (i.e., the volume of the second fluid chamber 36 is reduced), through orifice 16, and in to the first fluid chamber 34 (i.e., the volume of the first fluid chamber 34 is increased). Thus, the axial length of the hydraulic compensator 11 increases. Because of the virtual incompressibility of hydraulic fluid and the relatively small diameter (e.g., approximately 30 microns) of orifice 16, the hydraulic compensator 11 acts like a structure that maintains the axial positioning of the piezoelectric device 52 with respect to the closure member 58.

During subsequent temperature fluctuations of the fuel injector assembly 10, any further expansion or contraction of the injector housing 60 and valve body 50 causes the hydraulic fluid 35 to travel between the first and second fluid chambers 34,36 via the orifice 16. Thus, the piezoelectric device 52 is displaced with respect to the injector housing 60 and the valve body 50 so as to maintain the proper operating relationship of the piezoelectric device 52 and the closure member 58, i.e., operation of the piezoelectric device 52 produces the open and closed configurations of the closure member 58, regardless of the temperature of the fuel injector 10.

The advantages that can be achieved by the hydraulic compensator 11 are believed to include compensating for the different thermal expansions of the various components of a fuel injector under all operating temperatures, eliminating exotic materials for better manufacturability, compensating for component tolerances, and compensating for changes in lift set over time. Additional advantages are believed to include a more compact design reducing axial length of the fuel injector, fewer and less expensive parts, and a method of assembly (as will be described hereinafter) that minimizes the chances that any residual air could be trapped inside the compensator and thus interfere with the operation of the hydraulic compensator.

Figure 3B:
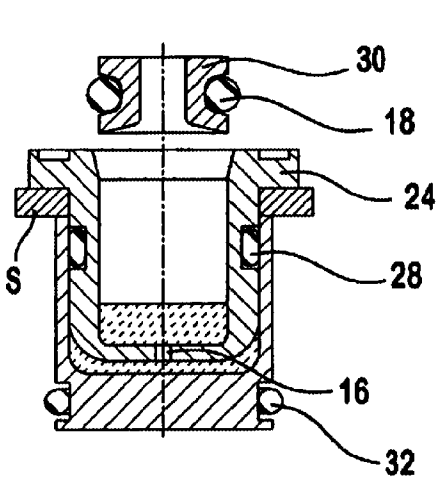
FIGS. 3A–3D illustrate a method of assembling the hydraulic compensator shown in FIG. 1.
Figure 3D:
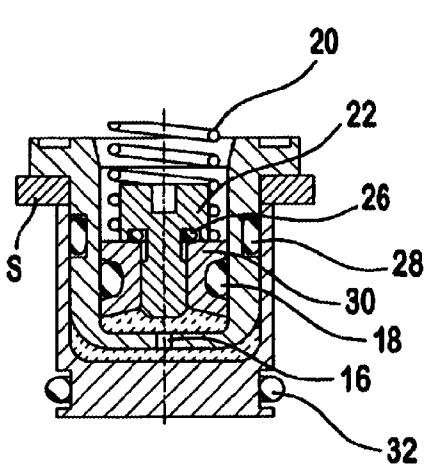
Figure 3A:
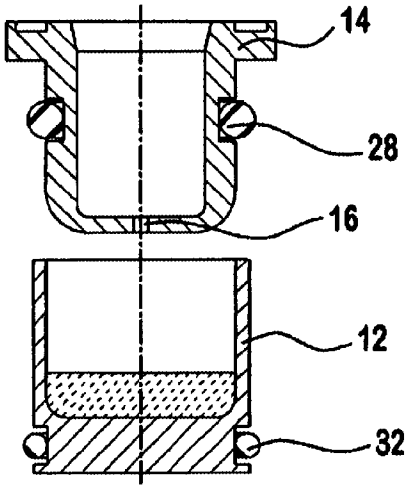

Referring now to FIGS. 3A–3D, and initially to FIG. 3A, a preferred embodiment of a method for assembling the hydraulic compensator 11 will now be described. A first portion of a preset volume of hydraulic oil is poured inside the first tube 12.

Referring now to FIG. 3B, the second tube 14, with the external O-ring 28 already positioned in the groove 27, is telescopically inserted into the first tube 12 to a preset relative axial position. In order to facilitate obtaining the preset relative axial position, a calibrated thickness spacer S is temporarily located between the rim of the first tube 12 and the underside of the flange 24 of the second tube 14. The spacer S is calibrated such that its axial dimension is related to the preset volume of the hydraulic oil. For example, the axial dimension can be preset so that the amount of hydraulic oil completely fills the included volume of the chambers 34,36 and the orifice 16, and yet minimizes the amount of hydraulic oil that is purged when the plug 22 is inserted into the aperture in the back-up piston 30. The spacer S can be shaped to facilitate its temporary installation at the beginning of the assembly method and its subsequent removal. According to a preferred embodiment, the spacer S can have a U-shape when viewed from along the axis A.

A second portion of the preset volume of hydraulic oil can be poured in at this time. The back-up piston 30, with the-ring 18 already installed in the groove 29, is now telescopically inserted into the second tube 14. The back-up piston 30 is inserted until the hydraulic oil just reaches the top of the back-up piston 30, i.e., through the aperture in the back-up piston 30. Any air that is trapped in the hydraulic oil is purged.

Figure 3C:
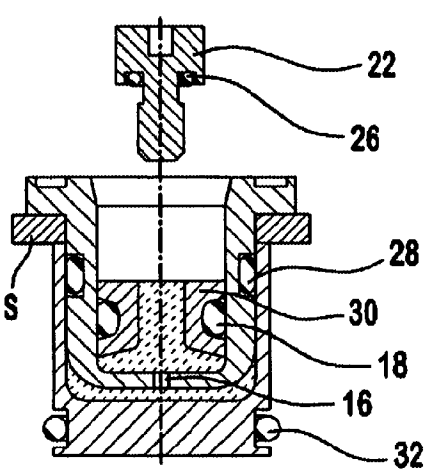
Figure 4:
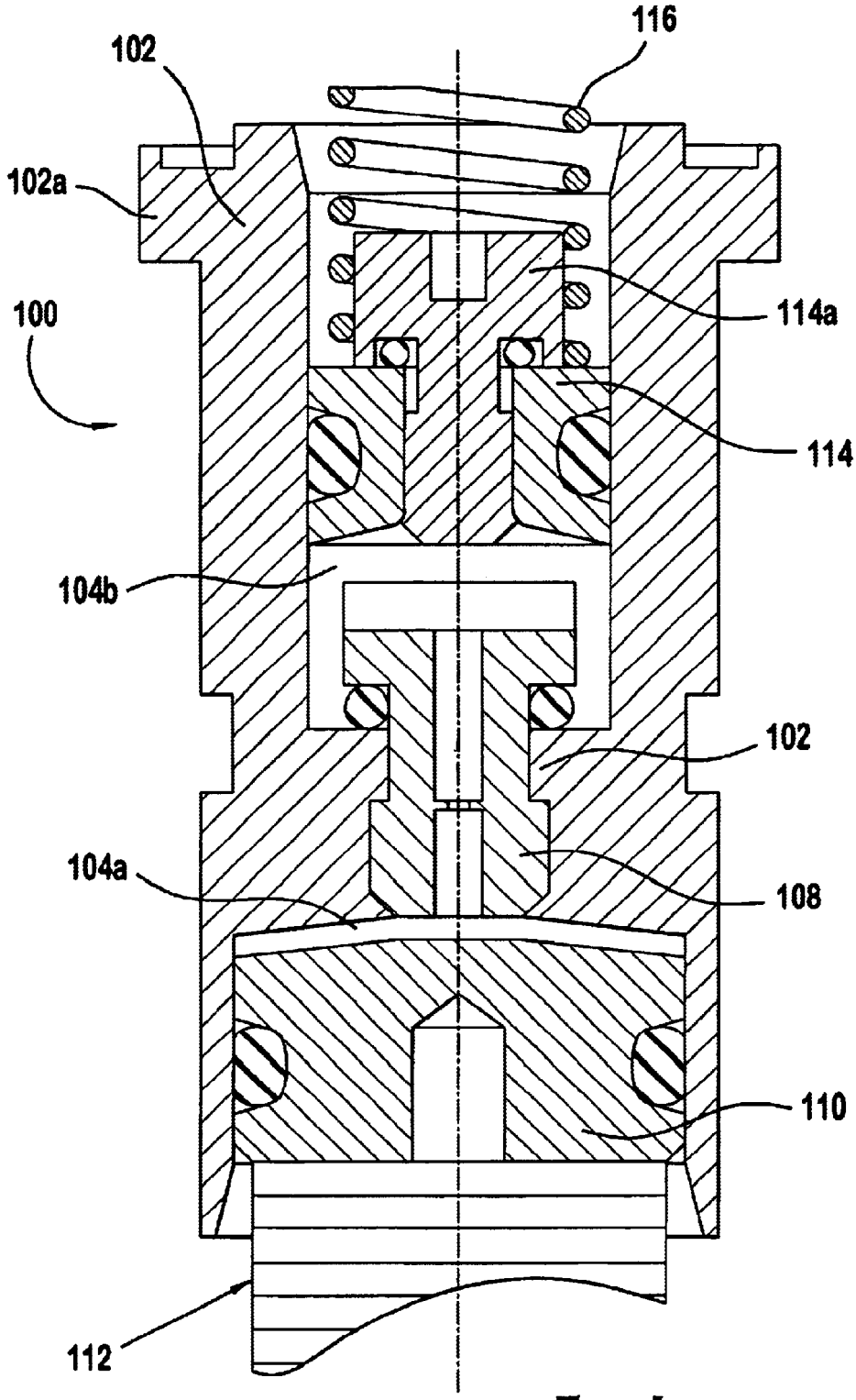
FIG. 4 is a cross-section view of a conventional hydraulic compensator.

Referring now to FIG. 3C, the plug 22 is inserted into the aperture and secured, e.g., by threaded engagement, in the back-up piston 30. It is notable that at all times during the assembly, the orifice 16 is always under the level of the hydraulic oil, thus minimizing the chances that any residual air trapped inside the hydraulic compensator 11 could interfere with its operation.

Referring finally to FIG. 3D, the temporary spacer S can be removed and the hydraulic compensator 11 can be operatively coupled in the fuel injector 10. For example, the first tube 12 can be placed in contiguous engagement with the piezoelectric device 52, the second tube 14 can be fixed with respect to the injector housing 60, and the resilient element 20 can be positioned between the back-up piston 30 and an adjuster mechanism.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof

What is claimed is:

1. A compensator for longitudinally positioning along an axis a device relative to a body, the compensator comprising:

a first tube extending along the axis from a first end portion occluding the first tube;

a second tube being telescopically received in the first tube, the second tube extending along the axis from a second end portion generally occluding the second tube and defining an orifice;

a piston being telescopically received in the second tube; and a fluid being displaceable through the orifice to move the first tube relative to the second tube.

2. The A compensator for longitudinally positioning along an axis a device relative to a body, the compensator comprising:

a first tube extending along the axis from a first end portion occluding the first tube;

a second tube being telescopically received in the first tube, the second tube extending along the axis from a second end portion generally occluding the second tube and defining an orifice;

a piston being telescopically received in the second tube; and a fluid being displaceable through the orifice to move the first tube relative to the second tube, wherein the first tube is adapted to be coupled to the device and the second tube is adapted to be coupled to the body.

3. The compensator according to claim 2, wherein the first tube is adapted to contiguously engage the device and the second tube is adapted to be fixed to the body.

4. The compensator according to claim 2, wherein the second tube comprises a flange adapted to contiguously engaged the body.

5. The compensator according to claim 2, wherein the fluid is displaceable between first and second chambers, the first chamber being defined by the first tube and the first and second end portions, and the second chamber being defined by the second tube, the second end portion, and the piston.

6. The compensator according to claim 5, wherein the first and second chambers comprise variable volume chambers.

7. The compensator according to claim 6, wherein a first volume of the first chamber is varied by relative movement between the first and second tubes, and a second volume in the second chamber is varied by relative movement between the second tube and the piston.

8. The compensator according to claim 2, wherein the piston comprises an aperture and a plug, the aperture provides ingress and egress for the fluid, and the plug fixes a volume of the fluid.

9. The compensator according to claim 2, further comprising:

a first seal between the first and second tubes; and a second seal between the second tube and the piston.

10. The compensator according to claim 9, wherein the first seal comprises a first O-ring and the second seal comprises a second O-ring.

11. The compensator according to claim 10, wherein the second tube comprises a first groove and the piston comprises a second groove, the first groove confronts the first tube and receives the first O-ring, and the second groove confronts the second tube and receives the second O-ring.

12. The compensator according to claim 2, wherein the fluid comprises substantially incompressible fluid.

13. A fuel injector comprising:

a body extending along an axis;

a closure member displaceable with respect to the body between a first configuration and a second configuration, the first configuration preventing fuel flow through the body, and the second configuration permitting fuel flow through the body;

a piezoelectric device displacing the closure member from the first configuration to the second configuration; and a compensator coupled with the piezoelectric device, the compensator including:

a first tube extending along the axis from a first end portion occluding the first tube, the first end portion contiguously engaging a first one of the body, the closure member, and the piezoelectric device;

a second tube being telescopically received in the first tube, the second tube extending along the axis from a second end portion generally occluding the second tube and defining an orifice, the second tube being fixed with respect to a second one of the body, the closure member, and the piezoelectric device;

a piston being telescopically received in the second tube, and a fluid being displaceable through the orifice to move the first tube relative to the second tube.

14. Fuel injector comprising:

a body extending along an axis;

a closure member displaceable with respect to the body between a first configuration and a second configuration, the first configuration preventing fuel flow through the body, and the second configuration permitting fuel flow through the body;

a piezoelectric device displacing the closure member from the first configuration to the second configuration; and a compensator coupled with the piezoelectric device, the compensator including:

a first tube extending along the axis from a first end portion occluding the first tube, the first end portion contiguously engaging a first one of the body, the closure member, and the piezoelectric device;

a second tube being telescopically received in the first tube, the second tube extending along the axis from a second end portion generally occluding the second tube and defining an orifice, the second tube being fixed with respect to a second one of the body, the closure member, and the piezoelectric device;

a piston being telescopically received in the second tube; and a fluid being displaceable through the orifice to move the first tube relative to the second tube, further including:

a resilient element interposed between the piston and the second one of the body, the closure member, and the piezoelectric device, the resilient element applying a biasing force tending to move the piston with respect to the second one of the body, the closure member, and the piezoelectric device.

15. The fuel injector according to claim 14, further comprising:

an adjustor interposed between the resilient element and the second one of the body, the closure member, and the piezoelectric device, the adjustor varying the biasing force being applied by the resilient element.

16. The fuel injector according to claim 15, wherein the piezoelectric device comprises opposite axial ends, a first one of the opposite axial ends contiguously engages the closure member, a second one of the opposite axial ends contiguously engages the first tube, the second tube is fixed with respect to the body, and the resilient element comprises a coil spring biasing the piston with respect to the body.

17. The compensator according to claim 14, wherein the fluid comprises substantially incompressible fluid.

18. A method of assembling a compensator for a fuel injector, the method comprising:

providing a first tube extending along an axis from a first end portion occluding the first tube;

filing the first tube with a volume of a fluid;

inserting a second tube telescopically in the first tube, the second tube extending along the axis from a second end portion generally occluding the second tube and defining an orifice, and the orifice being submerged in the volume of the fluid;

inserting a piston telescopically in the second tube, the piston including an aperture; and inserting a plug in the aperture.

19. A method of assembling a compensator for a fuel injector, the method comprising:

providing a first tube extending along an axis from a first end portion occluding the first tube;

filing the first tube with a volume of a fluid;

inserting a second tube telescopically in the first tube, the second tube extending along the axis from a second end portion generally occluding the second tube and defining an orifice, and the orifice being submerged in the volume of the fluid;

inserting a piston telescopically in the second tube, the piston including an aperture; and inserting a plug in the aperture, further including:

installing a temporary spacer limiting the inserting the second tube telescopically in the first tube.

20. The method according to claim 19, wherein the installing the temporary spacer comprises selecting an axial spacing dimension of the temporary spacer, the axial spacing dimension being related to the volume of the fluid.

* * * * *